United States Patent [19]

Masuda et al.

[11] Patent Number: 4,652,281

[45] Date of Patent: Mar. 24, 1987

[54] FILM-SHAPED DUST COLLECTING ELECTRODES AND ELECTRIC DUST COLLECTING APPARATUS HAVING A STACK OF THE SAME DUST COLLECTING ELECTRODES

[76] Inventors: Senichi Masuda, 3-2-1-415, Nishigahara, Kita-ku, Tokyo; Ryohei Yonezawa, 1891-11, Masuo, Kashiwa-shi, Chiba-ken; Kiyoshi Toida, 1547-2, Takahisa, Yoshikawa-machi, Kitakatsushika-gun, Saitama-ken, all of Japan

[21] Appl. No.: 746,541

[22] Filed: Jun. 19, 1985

[51] Int. Cl.[4] ..... B03C 3/08; B03C 3/47

[52] U.S. Cl. ..... 55/130; 55/145; 55/146; 55/155; 206/518

[58] Field of Search ..... 55/129, 130, 142, 143, 55/145, 155, 146; 206/499, 515, 516, 518

[56] References Cited

U.S. PATENT DOCUMENTS

| | | | |
|---|---|---|---|
| 1,786,733 | 12/1930 | Benoit | 206/501 |
| 2,473,240 | 6/1949 | Byrne | 55/143 X |
| 2,772,537 | 12/1956 | Lisciani | 55/440 |
| 4,249,919 | 2/1981 | Kalt | 55/130 |
| 4,313,741 | 2/1982 | Masuda et al. | 55/141 X |

*Primary Examiner*—Kathleen J. Prunner

*Attorney, Agent, or Firm*—Price, Heneveld, Cooper, DeWitt & Litton

[57] ABSTRACT

The specification discloses a film-shaped dust collecting electrode and an electric dust collecting apparatus having a stack of the electrodes. The electrode includes a conductive film painted onto a central area of a surface of a rectangular insulative film. A terminal base and a terminal conductor of a tongue shape extend from one shorter edge of the insulative film. A plurality of spacer protrusions are provided at spaced intervals along the opposite longer edges of the insulative film. The spacer protrusions along the opposite longer edges are staggered from one another with the conductive film intervening therebetween. Hollow frustoconical coupling protrusions are disposed symmetrically about the intersection of the two diagonal lines of the insulative film. The height of the coupling protrusions is higher than that of the spacer protrusions. In the dust-collecting apparatus, a plurality of the electrodes is stacked with the direction of terminal conductors alternately reversed. The coupling protrusions prevent relative displacement between adjacent electrodes.

6 Claims, 9 Drawing Figures

FILM-SHAPED DUST COLLECTING ELECTRODES AND ELECTRIC DUST COLLECTING APPARATUS HAVING A STACK OF THE SAME DUST COLLECTING ELECTRODES

BACKGROUND OF THE INVENTION

The present invention relates to film-shaped dust collecting electrodes in a dust capturing stage in a dust collecting apparatus which forms a part of an air cleaning equipment for removing dust, smoke of cigarettes, bad smell, etc. contained in a contaminated air within a room such as a vehicle occupant compartment, especially in an air within an enclosed room upon air-conditioning or upon rainy weather, and also to an electric dust collecting apparatus constructed by making use of the film-shaped dust collecting electrodes. In more particular, it relates to improvements in an assembly of film-shaped dust collecting electrodes forming a dust capturing section in the so-called two-stage type electric dust collecting apparatus in which dust in a contaminated air is charged in a charging stage and the charged dust is captured in a dust capturing stage.

Heretofore, the above-mentioned type of film-shaped dust collecting electrodes consisted of flat film-shaped dust collecting electrodes each made of a rectangular film of insulating material such as plastics or the like having a conductive thin film coated on its one principal surface with an uncoated margin left around the conductive thin film, and similar film-shaped dust collecting electrodes associated with spacers each of which electrode has a plurality of protrusions and recesses for use as spacers formed in the uncoated margin around the conductive thin film, and these two different kinds of film-shaped dust collecting electrodes were alternately stacked in multiple on one another to form a dust capturing stage in a two stage type electric dust collecting apparatus.

Accordingly, in order to form the dust capturing stage by making use of the aforementioned film-shaped dust-collecting electrodes, two kinds of electrodes consisting of the flat film-shaped dust collecting electrodes and the similar film-shaped dust collecting electrodes associated with spacers as described above were necessitated, and so the dust capturing stage was expensive in manufacturing cost as compared to a structure made of a single kind of film-shaped dust collecting electrodes.

Moreover, in the care of alternately stacking the above-mentioned two kinds of film-shaped dust collecting electrodes on one another, since there was no means for mutually engaging adjacent electrodes with each other, the respective electrodes were liable to displace relatively to each other in the directions at right angles to the direction of stacking of the electrodes, hence mutual positioning of the respective electrodes was troublesome, and consequently the assembling work pof the dust capturing stage necessitated a lot of time and labor.

SUMMARY OF THE INVENTION

One object of the present invention is to make it possible that a dust capturing stage of a two stage type electric dust collecting apparatus forming a part of the above-described air cleaning equipment is assembled by making use of a single kind of film-shaped dust collecting electrode, and also to make a manufacturing cost of the dust capturing stage less expensive as compared to the case of assembling it by making use of two kinds of film-shaped dust collecting electrodes and facilitate the assembling work of the dust capturing stage by preventing the respective electrodes from displacing relatively to each other upon the assembling work.

According to one feature of the present invention, there is provided a film-shaped dust collecting electrode formed by a rectangular film made of insulating material having a rectangular thin film made of conductive material integrally superimposed on one principal surface thereof with a bared margin left along one longer edge, the other longer edge and one shorter edge, the superimposed insulating film and conductive thin film being partly extended from the other shorter edge to form a terminal base and a terminal conductor of a tongue shape, in which a plurality of spacer protrusions are provided as aligned at a given interval in the margin along one longer edge and in the margin along the other longer edge, respectively, at such positions that a row of spacer protrusions provided in the margin along one longer edge may be opposed to a row of spacer protrusions provided in the margin along the other longer edge in a staggered relationship with the conductive thin film intervening therebetween, and at least two hollow frustoconical coupling protrusions are disposed symmetrically about a center of symmetry at a point of intersection of two diagonal lines on the rectangular film with their bottoms opening in the respective margins along the opposite longer edges, the height of the coupling portrusions being higher than that of the spacer protrusions.

According to another feature of the present invention, there is provided an electric dust collecting apparatus in which a large number of film-shaped dust collecting electrodes having the above-featured structures are stacked on one another as directed alternately in the opposite directions so that the terminal bases and the terminal conductors of a tongue shape of the respective electrodes may project alternately in the opposite directions, the gap distances between the respective adjacent film-shaped dust-collecting electrodes are maintained by the height of the spacer protrusions provided in the margin along the opposite longer edges of the respective electrodes, and alignment in the direction of stacking of the respective dust collecting electrodes is assured by mutual fitting of the frustoconical hollow coupling protrusions provided in the margin of the adjacent electrodes.

The above-mentioned and other features and objects of the present invention will become more apparent by reference to the following description of a preferred embodiment of the invention taken in conjunction with the accompanying drawings, wherein:

DETAILED DESCRIPTION OF THE PREFERRED EMBODIMENT

Figure 1:
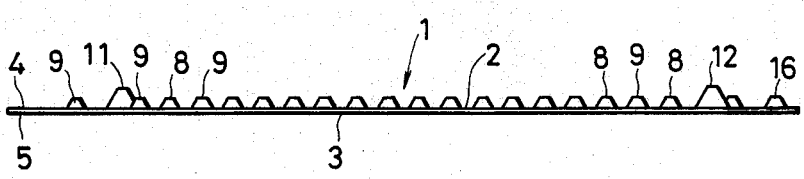
FIG. 1 is a side view of a film-shaped dust collecting electrode according to the present invention.

In a film-shaped dust collecting electrode 1 according to the present invention, one principal surface of a rectangular insulative film 2 made of insulating material such as plactics or the like is integrally coated with a rectangular conductive thin film 3 made of conductive material, leaving belt-shaped margin zones 2*a*, 2*b* and 2*c* along the opposite longer edges and one shorter edge thereof uncoated so as to coat the remaining portion, that is, the portion extending from the central zone of the one principal surface of the film 2 up to the other shorter edge, and at the other shorter edge of the film 2 and the conductive thin film 3 are integrally formed a terminal base 4 and a terminal conductor 5 of a tongue shape as extended from the other shorter edge. In this film-shaped dust collecting electrode 1, a large number of frustoconical hollow spacer protrusions 8 and 9 having top walls 8*a* and 9*a* and open bottoms 8*b* and 9*b*, respectively, are provided in the margin zones 2*a* and 2*b*, respectively, along the opposite longer edges as aligned at given intervals 6 and 7, respectively. Also, spacer protrusions 16 of the same shape are provided in the margin zone 2*c* along one shorter edge; and a row of spacer protrusions 8, provided in the margin zone 2*a* along one longer edge, is opposed to a row of spacer protrusions 9, provided in the margin zone 2*b* along the other longer edge in a staggered relationship with the rectangular conductive thin film 3 intervening therebetween. That is, the intervals 6 between the respective spacer protrusions 8 in the margin zone 2*a* along one longer edge are positioned so as to oppose the corresponding spacer protrusions 9 in the margin zone 2*b* along the other longer edge with the rectangular conductive thin film 3 intervening therebetween.

At a pair of symmetric positions having their center of symmetry at a point of intersection p of two diagonal lines (indicated by chain lines in FIG. 2) of the rectangular film 2, in the respective margin zones 2*a* and 2*b* along the opposite longer edges, are provided frustoconical hollow coupling protrusions 11 and 12 having their bottoms 11*b* and 12*b* opened, and the height of these coupling protrusions 11 and 12 is made higher than that of the spacer protrusions 8 and 9.

Figure 2:
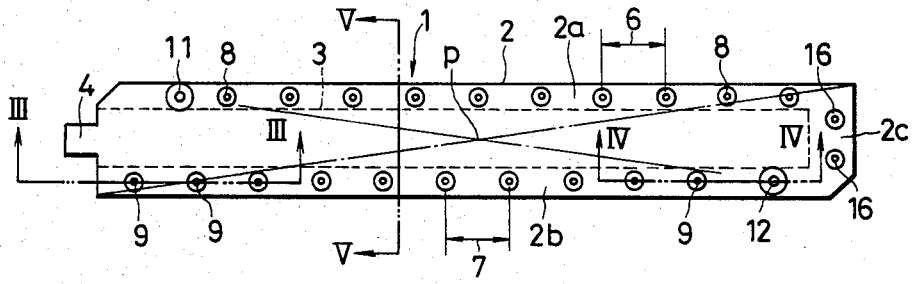
FIG. 2 is a plan view of the same electrode.
Figure 3:
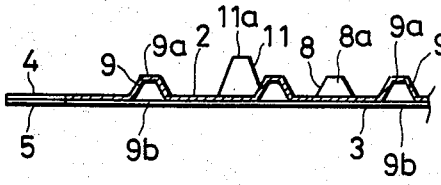
FIG. 3 is an enlarged partial cross-section view taken along line III—III in FIG. 2 as viewed in the direction of arrows.
Figure 4:
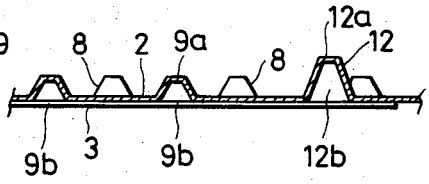
FIG. 4 is an enlarged partial cross-section view taken along line IV—IV in FIG. 2 as viewed in the direction of arrows.
Figure 5:
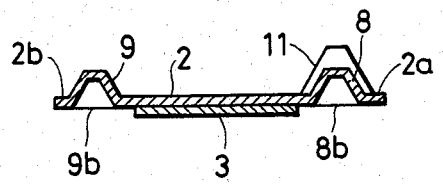
FIG. 5 is an enlarged cross-section view taken along line V—V in FIG. 2 as viewed in the direction of arrows.
Figure 6:
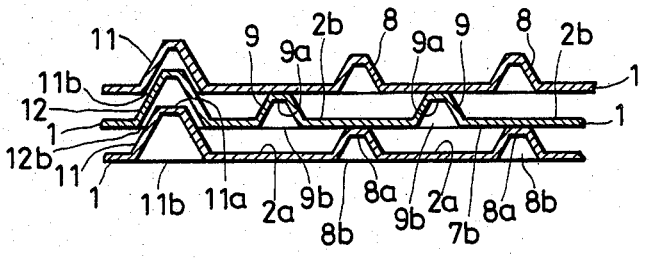
FIG. 6 is an enlarged partial cross-section view showing a stacked state of a plurality of film-shaped dust collecting electrodes, each of which is shown in FIGS. 1 to 5.

When such film-shaped dust collecting electrodes 1 are stacked on one another with their terminal bases 4 directed alternately in the opposite directions, that is, in such manner that the successive stacked film-shaped dust collecting electrodes are rotated by 180° about the center of symmetry p in FIG. 2 one after another, a top wall 8*a* of the spacer protrusion 8 in the margin zone 2*a* along one longer edge of one film-shaped dust collecting electrode 1 would butt against a bottom surface 7*b* of the margin zone 2*b* along the other longer edge of the next upper film-shaped dust collecting electrode 1, and thereby an interval between adjacent dust collecting electrodes 1 can be maintained at a given distance, as shown in FIG. 6.

Upon such stacking of the film-shaped dust collecting electrodes, since the frustoconical hollow coupling protrusions 11 and 12 having their bottoms 11*b* and 12*b* opened are provided in the respective margin zones 2*a* and 2*b*, respectively, along the opposite longer edges symmetrically with respect to a point of intersection p of the diagonal lines of the rectangular electrode 1, if one of adjacent dust collecting electrodes 1 is rotated by 180° about the center of symmetry p relative to the other electrode 1, then as shown in FIG. 6 above a top wall 11*a* of the hollow coupling protrusion 11 provided in the margin zone 2*a* along one longer edge of one dust collecting electrode 1 is positioned an opening at a bottom 12*b* of the hollow coupling protrusion 12 provided in the margin zone 2*b* along the other longer edge of the next upper dust collecting electrode 1, hence the top wall 11*a* of the hollow coupling electrode 11 enters in the opening at the bottom 12*b* of the hollow coupling protrusion 12 to an extent corresponding to a difference between the height of the coupling protrusions 11 and 12 and that of the spacer protrusions 8 and 9, and thereby relative displacement between the dust collecting electrodes 1 in the directions at right angles to the direction of stacking can be prevented.

In other words, with the film-shaped dust collecting electrodes according to the present invention, even though the dust collecting electrodes are of a single kind in configuration, an interval between adjacent electrodes can be maintained at a given distance with the aid of the spacer protrusions 8 and 9 by stacking a large number of these film-shaped dust collecting electrodes on one another as directed alternately in the opposite directions, and also an aligned coupling condition between adjacent dust collecting electrodes can be automatically maintained by fitting the upper walls 11*a* and 12*a* of the frustoconical hollow coupling protrusions 11 and 12 of one dust collecting electrode, respectively, into the openings at the bottoms 12*b* and 11*b* of the hollow coupling protrusions 12 and 11 of the next upper dust collecting electrode. Accordingly, the work of stacking a large number of these electrodes as shown in FIG. 6 becomes very easy.

Figure 7:
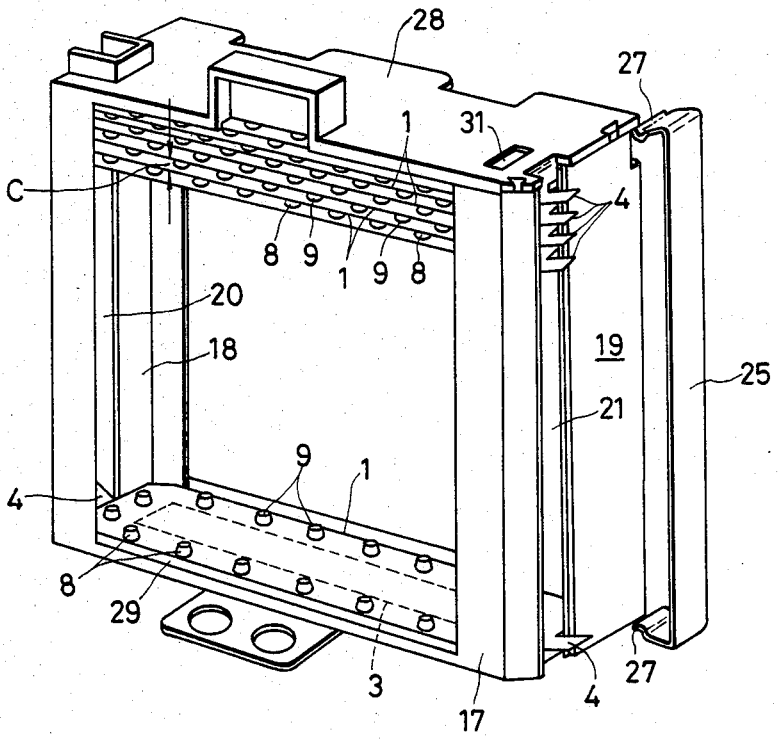
FIG. 7 is a perspective view of an electric dust collecting apparatus, in which a large number of film-shaped dust collecting electrodes, each of which is shown in FIGS. 1 to 5, are stacked and mounted to a frame body.
Figure 8:
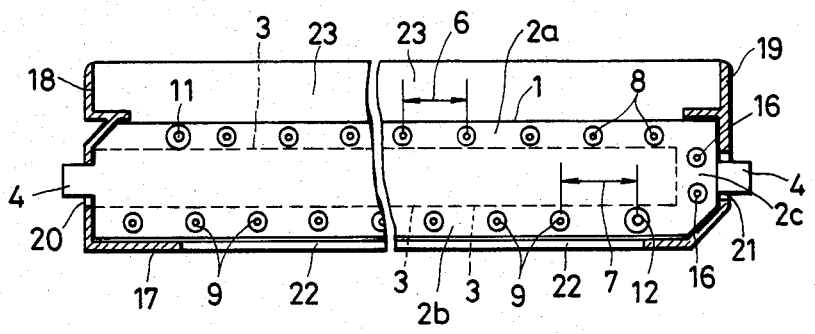
FIG. 8 is a transverse cross-section view of the electric dust collecting apparatus shown in FIG. 7.

FIG. 7 shows a dust capturing stage of a dust collecting apparatus formed by assembling the above-described dust collecting electrodes 1 within a casing 17 made of insulating material such as plastics or the like.

More particularly, a large number of dust collecting electrodes 1 are stacked on one another between a bottom plate 29 and a top plate 28 within the casing 17 in such manner that their terminal bases may be directed alternately in the opposite directions, an interval C between adjacent dust collecting electrodes may be maintained at a given distance with the aid of the spacer protrusions 8 and 9, relative displacement between the respective electrodes may be prevented by fitting between the frustoconical hollow coupling protrusions 11 and 12, and the respective groups of terminal bases 4 of the alternate dust collecting electrodes 1 may project externally through elongated openings 20 and 21, respectively, in the side walls 18 and 19 of the casing 17.

Figure 9:
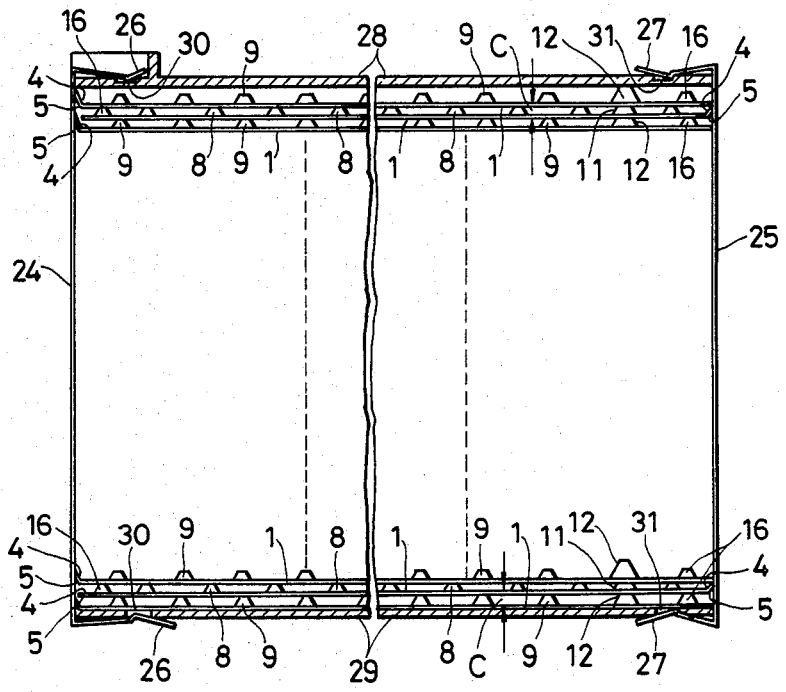
FIG. 9 is a longitudinal cross-section view of the electric dust collecting apparatus shown in FIG. 7.

Conductive headers 24 and 25 are urged against the respective groups of terminal bases 4 projecting through the elongated openings 20 and 21, respectively, from the outside of the casing 17 so that the terminal conductors 5 formed on the lower surface of the terminal bases 4 as extensions of the conductive thin films 3 may be brought into electrical contact with the header 24 or 25. Resilient engaging tabs 26 and 27 formed at the opposite ends of the respective headers 24 and 25 are engaged with counterpart engaging apertures 30 and 31 opened in the top plate 28 and the bottom plate 29 as best seen in FIG. 9, and thereby the above-described electrical contact condition between the terminal conductors 5 and the headers 24 and 25 can be maintained.

In the dust capturing stage of the electric dust collecting apparatus assembled in the above-described manner, if electric fields are established between the respective pairs of adjacent dust collecting electrodes 1 by applying a high voltage therebetween, and if contaminated air containing dust which has been charged in a separate charging stage not shown is made to flow into the dust capturing stage from an air flow inlet 22, then the charged dust is attracted towards one of the adjacent dust collecting electrodes 1 by a Coulombs' force therebetween and adheres to that electrode 1, and clean air having dust therein removed is delivered from an air flow outlet 23 into, for instance, a vehicle occupant compartment as described above.

While the present invention has been described above in connection to one preferred embodiment thereof illustrated in the accompanying drawings, the invention should not be limited to only the illustrated embodiment but various changes and modifications could be made in practical structures and configurations without departing from the scope of the invention.

For instance, the film 2 forming the above-described dust collecting electrode 1 is not limited to plastics only as described above but paper or other sheet-shaped insulating materials could be replaced therefor, and the conductive thin film 3 can be realized either by vapor-depositing metal on the film 2 or applying a metal foil onto the film.

Also it is possible to modify the numbers and configurations of the spacer protrusions 8 and 9 and the coupling protrusions 11 and 12 within the scope not interfering the objects of the present invention.

What is claimed is:

1. An electrode comprising:

a rectangular insulative film having first and second opposite surfaces, said insulative film including a central area and a margin area extending about said central area and along both longer edges and one short edge of the insulative film, said insulative film including a plurality of spacer protrusions in the margin area spaced evenly in a row along each of said longer edges, said spacer protrusions along one said longer edge being staggered from said spacer protrusions along the other said longer edge, said insulative film further including two hollow frustoconical coupling protrusions disposed symmetrically about the intersection of the diagonals of said rectangular insulative film, said coupling protrusions also being in said margin area along said longer edges, all of said spacer and coupling protrusions extending from said first surface, the height of said coupling protrusions being greater than the height of said spacer protrusions; and a rectangular conductive film integrally superimposed on the second surface over said central area only, both of said films extending from the other short edge of said insulative film to form a terminal base and conductor of tongue shape.

2. A film-shaped dust collecting electrode as claimed in claim 1, in which said insulative film is a plastic sheet.

3. A film-shaped dust collecting electrode as claimed in claim 1, in which said insulative film is a paper sheet.

4. A film-shaped dust collecting electrode as claimed in claim 1, in which said conductive film is a metallic vapor-deposited layer.

5. A film-shaped dust collecting electrode as claimed in claim 1, in which said conductive film is a metal foil.

6. An electric dust collecting apparatus, in which a plurality of electrodes as claimed in claim 1 are stacked on one another within a casing having an air flow inlet and an air flow outlet with said terminal bases of the successive electrodes directed alternately in opposite directions to form two groups of said terminal conductors, and in which conductive headers are urged against said groups of said terminal conductors to make electrical contact with the terminal conductors.

* * * * *